US011105229B2

(12) United States Patent
Weber et al.

(10) Patent No.: US 11,105,229 B2
(45) Date of Patent: Aug. 31, 2021

(54) HYDRAULIC CAMSHAFT ADJUSTER

(71) Applicant: SCHAEFFLER TECHNOLOGIES AG & CO. KG, Herzogenaurach (DE)

(72) Inventors: Juergen Weber, Erlangen (DE); Jochen Thielen, Nuremberg (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/489,706

(22) PCT Filed: Feb. 8, 2018

(86) PCT No.: PCT/DE2018/100105

§ 371 (c)(1),
(2) Date: Aug. 29, 2019

(87) PCT Pub. No.: WO2018/157881

PCT Pub. Date: Sep. 7, 2018

(65) Prior Publication Data

US 2020/0072093 A1 Mar. 5, 2020

(30) Foreign Application Priority Data

Mar. 2, 2017 (DE) ..... 10 2017 104 348.9

(51) Int. Cl.
*F01L 1/344* (2006.01)

(52) U.S. Cl.
CPC ... *F01L 1/3442* (2013.01); *F01L 2001/34426* (2013.01); *F01L 2001/34453* (2013.01); *F01L 2001/34479* (2013.01)

(58) Field of Classification Search
CPC ..... F01L 1/3442; F01L 2001/34433; F01L 2001/34426; F01L 1/344; F01L 2001/3443; F01L 2001/34423; F01L 2001/34479

(Continued)

(56) References Cited

U.S. PATENT DOCUMENTS

2005/0066924 A1 3/2005 Lehmann et al.
2008/0149056 A1 6/2008 Grunow (Continued)

FOREIGN PATENT DOCUMENTS

CN 104662264 A 5/2015
CN 104685166 A 6/2015

(Continued)

OTHER PUBLICATIONS

DE-102012213002-A1, Jan. 2014, English Language Machine Translation.*

(Continued)

*Primary Examiner* — Patrick Hamo
*Assistant Examiner* — Wesley G Harris
(74) *Attorney, Agent, or Firm* — Dickinson Wright PLLC

(57) ABSTRACT

A hydraulic camshaft adjuster has a stator, a rotor arranged movably with respect to the stator, and a central valve via which oil supply of working chambers of the hydraulic camshaft adjuster is controlled. A deformable sealing sleeve is arranged between the central valve and the rotor. The sealing sleeve has an initial length in an axial direction, and after assembly, has a deformation such that the length of the sealing sleeve changes from the initial length to an assembled length. The sealing sleeve bears at least partially in the radial direction against the central valve and against the rotor.

13 Claims, 3 Drawing Sheets

(58) Field of Classification Search
USPC ..... 123/90.17, 90.15
See application file for complete search history.

(56) References Cited

U.S. PATENT DOCUMENTS

| | | | |
|---|---|---|---|
| 2012/0255509 | A1 | 10/2012 | Lichti et al. |
| 2014/0158075 | A1 | 6/2014 | Dogan et al. |

FOREIGN PATENT DOCUMENTS

| | | | | | |
|---|---|---|---|---|---|
| CN | 105556073 | A | | 5/2016 | |
| DE | 102008057492 | A1 | | 5/2010 | |
| DE | 102011007745 | A1 | * | 10/2012 | ..... F16K 27/048 |
| DE | 102012213002 | A1 | * | 1/2014 | ..... F01L 1/3442 |
| DE | 102012213002 | A1 | | 1/2014 | |
| DE | 102015200538 | A1 | | 7/2016 | |
| EP | 2500531 | A1 | | 9/2012 | |
| JP | 2006200390 | A | * | 8/2006 | ..... F02F 7/006 |
| WO | WO-2011098361 | A1 | * | 8/2011 | ..... F16K 11/07 |

OTHER PUBLICATIONS

International Search Report for International Application No. PCT/US2018/100105 dated Apr. 25, 2018.

* cited by examiner

HYDRAULIC CAMSHAFT ADJUSTER

CROSS-REFERENCE TO RELATED APPLICATIONS

This application is the U.S. National Phase of PCT/DE2018/100105 filed Feb. 8, 2018, which claims priority to DE 102017104348.9 filed Mar. 2, 2017, the entire disclosures of which are incorporated by reference herein.

TECHNICAL FIELD

This disclosure relates to a hydraulic camshaft adjuster, and a method for producing such a hydraulic camshaft adjuster.

BACKGROUND

Hydraulic camshaft adjusters are used in internal combustion engines to adjust the valve control times of the intake and discharge valves of the internal combustion engine to a load state of the internal combustion engine and thus increase the efficiency of the internal combustion engine. Hydraulic camshaft adjusters are known from the prior art that function according to the vane pump principle. Hydraulic camshaft adjusters generally have a stator that can be driven by an internal combustion engine crankshaft, and a rotor that can be connected to a camshaft of the internal combustion engine for conjoint rotation. An annular space is formed between the stator and the rotor, which is divided into numerous working chambers by inward radial projections that are connected to the stator for conjoint rotation, wherein each of the working chambers is divided into two pressure chambers by a vane projecting radially outward from the rotor. Depending on the pressure applied by a pressure medium to the pressure chambers, the rotor is adjusted in relation to the stator, and thus the camshaft is adjusted in relation to the crankshaft, in either the direction "early" or "late." By hydraulically pressurizing the pressure chambers appropriately, the position of the rotor in relation to the stator can be altered, and thus the control times for the valves of the internal combustion engine can be adjusted.

A hydraulic camshaft adjuster is known from DE 10 2012 112 059 A1, in which a sleeve is located in an annular space between the rotor and a central valve of the camshaft adjuster, and this annular space is divided into two different sub-spaces, wherein one sub-space is connected to a first hydraulic pressure chamber of the camshaft adjuster, and the second sub-space is connected to a second hydraulic pressure chamber of the camshaft adjuster. The sleeve is pressed into a hole in the rotor, and is sealed by means of a sealing ring. The sleeve also has openings that allow the hydraulic fluid to flow from the central valve into the pressure chambers.

A hydraulic camshaft adjuster is also known from DE 10 2012 213 002 A1 that has a cylindrical sleeve between the central valve and the rotor, which has numerous sealing sleeves for hydraulically sealing the individual intakes and discharges of the pressure chambers of the hydraulic camshaft adjuster, wherein the sleeve can be connected in a force and/or form fit to the central valve.

US 2012 255 509 A1 describes a hydraulic camshaft adjuster that has a sleeve that is coaxial to the central valve, which is used for conducting oil to the respective pressure chambers of the hydraulic camshaft adjuster.

DE 10 2008 057 492 A1 describes a hydraulic camshaft adjuster that has a fluid conducting unit, through which the power train of the central screw passes. The fluid conducting unit has a fluid conducting groove on its internal radial surface, via which the pressure chambers can be supplied with hydraulic fluid from the central screw.

DE 10 2015 200 538 A1 describes a camshaft adjuster that has a rotor and a concentric central screw, wherein at least two hydraulically separate oil conducting channels are formed between an inner diameter of the rotor and an outer diameter of the central screw, wherein the oil conducting channels are formed in a component placed in the inner diameter of the rotor, or they are hydraulically separated by a component pressed in between the inner diameter of the rotor and the outer diameter of the central screw.

The known solutions have the disadvantage that the seal between the rotor and the central valve is comparatively complex and expensive, and the hydraulic camshaft adjuster requires more effort to assemble.

SUMMARY

One object of this disclosure is to propose a hydraulic seal between the central valve and the rotor, which can be produced and assembled inexpensively, resulting in a reliable hydraulic seal between the two components, thus improving the regulation of the hydraulic camshaft adjuster.

This object can be achieved according with a hydraulic camshaft adjuster that has a stator, and a rotor that can move in relation to the stator, as well as a central valve, which controls the oil supply to the working chambers of the hydraulic camshaft adjuster, wherein a deformable sealing sleeve is located between the central valve and the rotor, wherein the sealing sleeve exhibits an initial axial length in an initial state in which it is not subjected to forces, and is deformed after assembly, such that the length of the sealing sleeve changes from the initial length to a length in the assembled state, wherein the sealing sleeve bears radially, at least in sections, on the central valve and the rotor. The sealing sleeve may exhibit an initial length that is not equal to the clamping length of the rotor. As a result, a hydraulic camshaft adjuster is obtained that is particularly simple to assemble, and which minimizes the seal between the central valve and the rotor. The oil consumption of the camshaft adjuster can consequently be reduced, and the regulation of the hydraulic camshaft adjuster can be improved.

According to embodiments of this disclosure, the sealing sleeve has a skin surface in the form of a bellows. When the skin surface of the sealing sleeve is in the form of a bellows, the sealing sleeve is deformed by the assembly force in a targeted manner at the folds of the bellows, such that the respective crests bear on the rotor and the central screw. The sealing sleeve exhibits a high level of elasticity in this case, such that only a small amount of force is needed to obtain the desired deformation for the assembly.

Advantageous improvements and further developments of the hydraulic camshaft adjuster are described herein.

In an embodiment of the hydraulic camshaft adjuster, the sealing sleeve has a contour that deviates from a cylindrical shape. As a result of this contour, the stiffness of the sealing sleeve can be reduced. This enables a defined deformation and bulging of the sealing sleeve during assembly, such that the sealing sleeve bears on the rotor and the central valve at the appropriate points.

According to an embodiment of this disclosure, the sealing sleeve has a first section with a first diameter and at least one second section with a second diameter, which is greater than the first diameter. Because of the first section with a first diameter and the second section with a larger diameter, oil conducting channels can be easily formed between the respective contact points that serve as a seal between the central valve and the rotor, such that hydraulic camshaft adjuster oil can flow from the central valve into the corresponding working chambers of the hydraulic camshaft adjuster and back.

In another embodiment of the hydraulic camshaft adjuster, the sealing sleeve has at least one opening on its skin surface, and in some embodiments, numerous openings, for supplying hydraulic fluid to the working chambers of the hydraulic camshaft adjuster. Numerous hydraulic connections can be formed between the central valve and the working chambers of the hydraulic camshaft adjuster with the numerous openings. As a result, throttle losses can be reduced, and the working chambers can be filled or emptied more quickly.

According to another embodiment, ridges are formed on a skin surface of the sealing sleeve, which project in semicircles or ramps over a cylindrical body of the sealing sleeve.

In another embodiment of the hydraulic camshaft adjuster, the hydraulic camshaft adjuster has a center lock that is activated hydraulically. Extensive leakage in a hydraulic camshaft adjuster that has a center lock can lead to an unintended unlocking of the camshaft adjuster from the locked setting. The pressure in the channel that controls the locking of the locking pin of the hydraulic camshaft adjuster then increases to the point where the locking pin is pushed into the unlocked position. With the approach according to the disclosure, which has a deformable sealing sleeve, the leakage is prevented, or at least reduced to the point where the risk of an unintended unlocking of the locking pin is eliminated, and the locking pin will always be securely locked or unlocked, depending on the hydraulic activation thereof.

A method is proposed according to embodiments for producing a hydraulic camshaft adjuster that has a stator and a rotor, as well as a central valve, which controls the oil supply to the working chambers of the hydraulic camshaft adjuster, in which a deformable sealing sleeve is located between the central valve and the rotor, which has an initial length in the initial state prior to assembly, in which it is not subjected to forces, that is deformed by the assembly forces in an elastic and/or plastic manner, such that the length of the sealing sleeve changes from the initial length to a length in the assembled state, wherein the sealing sleeve bears at least in sections on the central valve and on the rotor as a result of the radial deformation. By placing a deformable sleeve between the central screw and the rotor, the gap between the rotor and the central screw is minimized, or entirely closed, such that a seal is obtained between the two components.

The method according to embodiments of this disclosure provides that the sealing sleeve is compressed axially, such that the axial length of the sealing sleeve is reduced from the initial length, and a skin surface of the sealing sleeve is pushed outward and/or inward radially such that the skin surface bears in sections on the rotor and on the central valve. By compressing the sealing sleeve, the sealing sleeve is widened radially, such that the gap between the central valve and the rotor is closed, and the sealing sleeve bears firmly on both components. As a result of the radial expansion of the sleeve, diameter tolerances, coaxial differences, and misalignments between the central vale and the rotor due to production conditions can be compensated for. In addition, the geometry of the rotor can be simplified, because the diameter of the rotor in which the central valve is accommodated no longer needs to have ledges. Furthermore, it is no longer necessary to grind the outer diameter of the central valve, because larger diameter tolerances can be accommodated with the solution according to this disclosure. This results in a reduction in production costs for the hydraulic camshaft adjuster.

In an alternative embodiment of the method, the sealing sleeve is compressed radially, such that the length of the sealing sleeve is increased axially from the initial length, and may extend over the entire clamping length of the rotor. The sealing sleeve can be produced such that it is axially shorter than the clamping length of the rotor prior to assembly. By inserting the sleeve into a central opening in the rotor, the sleeve is compressed radially such that it is extended axially. A corresponding semicircular or ramp-shaped contour formed on the sealing sleeve results in a defined bending and associated deformation of the sealing sleeve.

BRIEF DESCRIPTION OF THE DRAWINGS

The disclosure shall be explained in greater detail below based on embodiments, with reference to the attached drawings. Identical components or components that have the same function are indicated by the same reference symbols in the drawings. Therein.

DETAILED DESCRIPTION OF THE DRAWINGS

Figure 1:
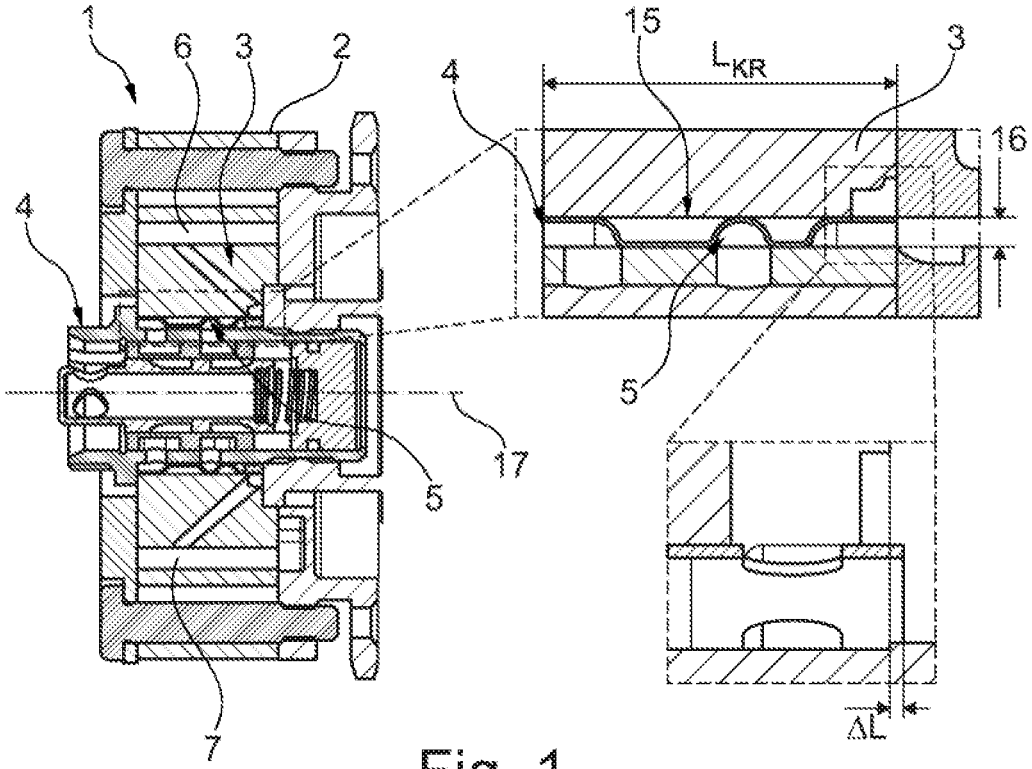
FIG. 1 shows a hydraulic camshaft adjuster according to an embodiment, which has a sealing sleeve between the central valve and the rotor.

A hydraulic camshaft adjuster 1 for adjusting the control times of the valves in an internal combustion engine is shown in FIG. 1. The hydraulic camshaft adjuster 1 has a stator 2 and a rotor 3. The rotor 3 and the stator 2 are arranged concentric to one another about a common central axis 17. The rotor 3 has a central opening in which a central valve 4 for the hydraulic control of the working chambers 6, 7 of the hydraulic camshaft adjuster 1 is located. Channels for supplying or discharging hydraulic fluid to or from the working chambers 6, 7 are formed in the stator 2 and/or the rotor 3. A gap 16 is formed between the rotor 3 and the central valve 4, into which a sealing sleeve 5 is inserted. The sealing sleeve 5 can be either inserted into the gap 16 with a certain amount of play, or it can be pressed into the opening in the rotor 3, or stretched onto the outer diameter of the central valve 4. It can be seen from the illustration in FIG. 1 that the clamping length $L_{KR}$ of the rotor 3 is shorter than the axial length $L_0$ of the sealing sleeve 5 in the unassembled state prior to installing the hydraulic camshaft adjuster 1 on a camshaft, not shown, when it is not subjected to forces, by a length of $\Delta L$. Because of the geometry of the sealing sleeve 5, an axial compression of the sealing sleeve 5 results in a radial expansion of the sealing sleeve 5. The central opening 15 in the rotor 3 can be in the form of a cylindrical bore hole, and requires no ledges in order to form channels for conducting oil, because these are formed by the first sections 9 of the sealing sleeve 5 between the sealing sleeve 5 and the rotor 3, and separated by the respective second sections 10 of the sealing sleeve 5.

Figure 2:
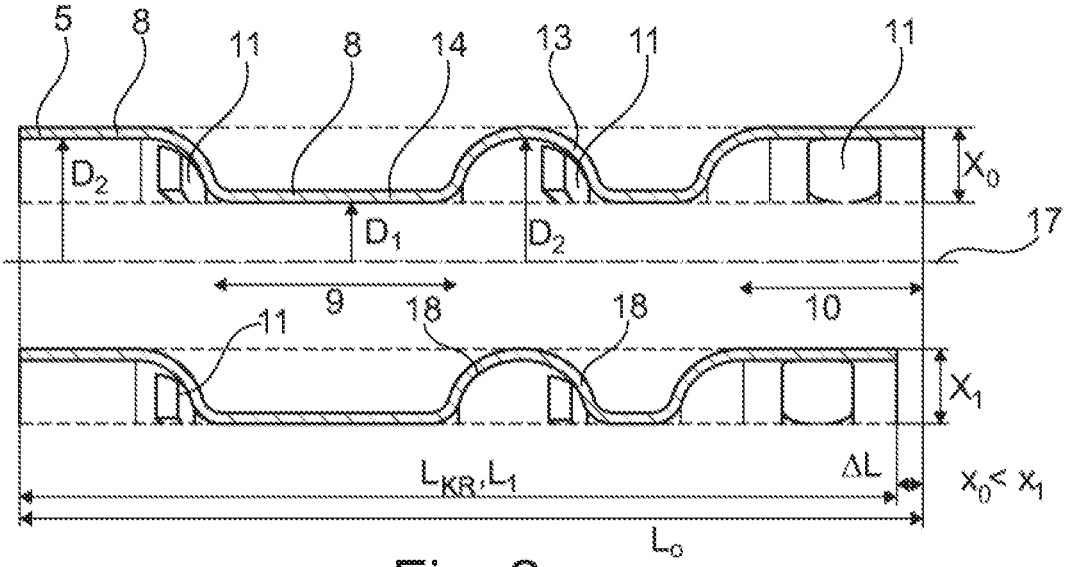
FIG. 2 shows a section through a sealing sleeve in the unloaded state, and when deformed by an assembly force.

The sealing sleeve 5 is shown in FIG. 2 in a sectional view in the unloaded initial state and after assembly of the hydraulic cam shaft adjuster 1. The geometry of the sealing sleeve 5 is selected such that an axial compression of the sealing sleeve 5 from an initial length $L_0$ to a length $L_1$ by the length $\Delta L$ causes a radial expansion of the sleeve from $X_0$ to $X_1$. The precise relationship between the length change $\Delta L$ and the expansion $\Delta X$ can be determined by the geometry of the sealing sleeve 5. If $\Delta X$ is at least as much as the gap 16, the sealing sleeve 5 forms a seal between the rotor 3 and the central valve 4. Even if the expansion of the sealing sleeve 5 $\Delta X$ is smaller than the gap 16, the seal is improved over prior designs as long as $X_1$ is smaller than the previously possible radial play between the central valve 4 and the rotor 3. The sealing sleeve 5 forms a seal between the central valve 4 and the rotor 3. The sealing sleeve 5 also serves as a sleeve for distributing oil into the working chambers 6, 7 of the hydraulic camshaft adjuster 1. For this, the sealing sleeve 5 has a first diameter $D_1$ at a first section 9, Which may be the smallest diameter of the sealing sleeve 5, allowing the sealing sleeve to be slid onto the central valve 5. Starting from this first diameter $D_1$, the sealing sleeve 5 has at least one second section 10 that has a larger diameter $D_2$, wherein the second sections 10 each form bearing surfaces of the sealing sleeve 5 on the rotor 3. There are numerous openings 11 formed on a skin surface 8 of the sealing sleeve 5 that enable a hydraulic control medium of the hydraulic camshaft adjuster 1 to flow through the sealing sleeve 5 from the central valve 4 into the working chambers 6, 7 of the hydraulic camshaft adjuster 1. Starting from a cylindrical body 14, the sealing sleeve 5 has numerous ridges 13 that may extend radially in semicircles or ramps over the cylindrical body 14. Numerous ridges 13 can adjoin one another in the manner of a bellows 12 such that the sealing sleeve 5 can be deformed particularly easily in this region, and potentially form numerous successive sealing edge(s). In order to enable a particularly simple deformation in the region of the ridges 13, the material of sealing sleeve 5 where the ridges 13 are located can be thinner than that of the cylindrical body 14. The thickness of the material may be substantially constant, however, over the entire length of the sealing sleeve 5, in order to keep the production costs for the sealing sleeve 5 as low as possible. Differences in the diameters due to production conditions, coaxial tolerances and misalignments between the central valve 4 and the rotor 3, can be compensated for by the radial expansion of the sealing sleeve 5 by the value $X_1$ and the elastic design of the sealing sleeve 5. Furthermore, the geometry of the rotor 3 in the region of the central opening 15 is simplified, because the inner diameter of the rotor 3 in which the central valve 4 is accommodated no longer needs ledges. The inner geometry of the rotor 3 can form a cylindrical surface. Furthermore, there is no longer need for a grinding of the outer diameter of the central valve 4, which had been necessary with the design known from the prior art in order to stay within the stipulations for tolerances and the leakage.

Figure 3:
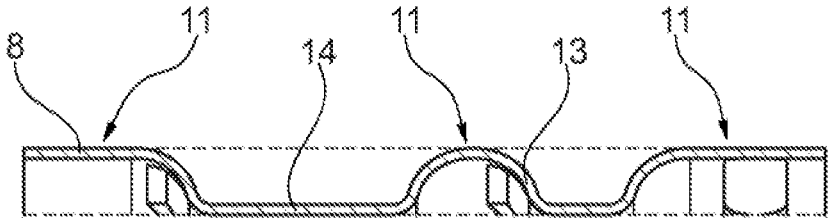
FIG. 3 shows another sectional view of a sealing sleeve.
Figure 4:
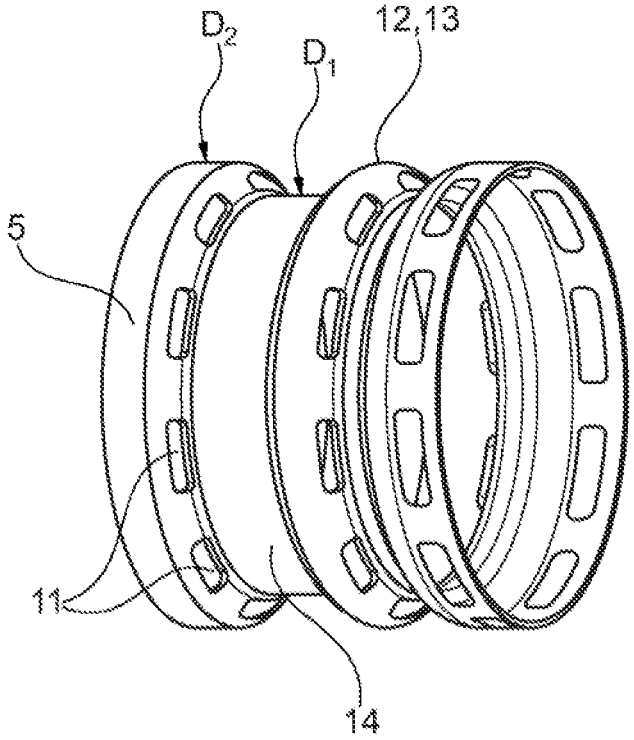
FIG. 4 shows a three dimensional illustration of a sealing sleeve, which is inserted between the rotor and the central valve.

Another illustration of a sealing sleeve 5 is shown in FIG. 3. It can be seen therein that the openings 11 are each formed in just one side 18 of the respective ridges 13, such that the crest of the respective ridge 13 forms a seal with the rotor 3, which hydraulically separates the individual oil supply channels from one another. FIG. 4 shows a three dimensional illustration of such a sealing sleeve 5, which has numerous ridges that hydraulically separate the channels conducting oil from the central valve 4 to the working chambers 6, 7.

Figure 5:
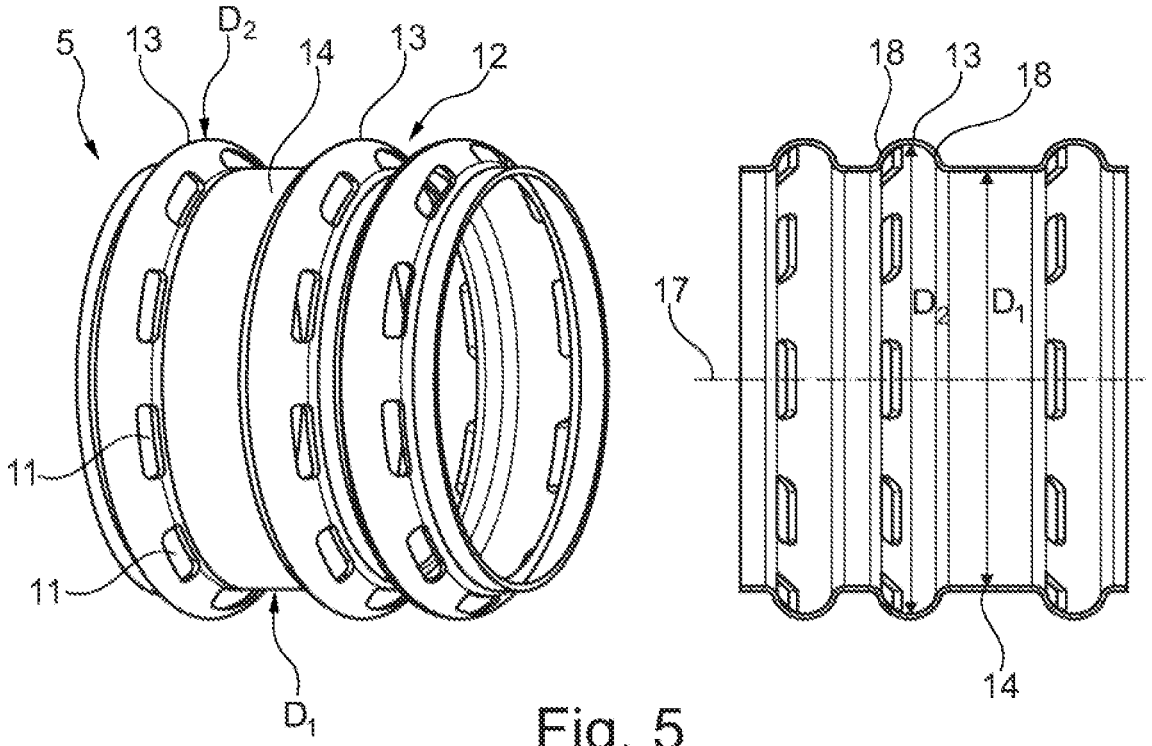
FIG. 5 Another exemplary embodiment of a sealing sleeve in a three dimensional illustration and in a sectional view.
Figure 6:
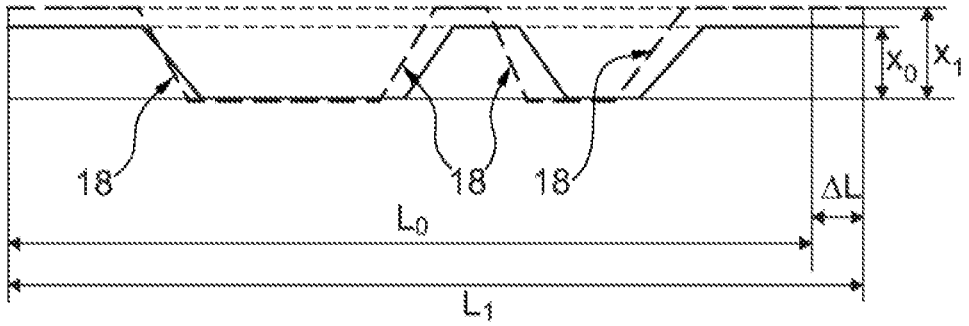
FIG. 6 shows a schematic illustration of the deformation and change in length of the sealing sleeve during assembly.

Alternatively, the sealing sleeve 5 can also be expanded axially by a radial compression. For this, the sealing sleeve shown in FIG. 5 and FIG. 6 is produced such that it has an axial length $L_0$ in the uninstalled state, when it is not subjected to forces, which is axially shorter than the clamping length $L_{KR}$ of the rotor 3 by $\Delta L$. The radial dimension $X_1$ of the sealing sleeve 5 in the initial state is greater than the gap 16 between the central valve 4 and the rotor 3. When the sealing sleeve 5 is inserted into the central opening 15 in the rotor 3, and the central valve 4 is installed, the sealing sleeve 5 is compressed radially from the initial height $X_1$ to the width of the gap 16, i.e. the height $X_0$. This assembly process and the associated deformation of the sealing sleeve 5 is illustrated schematically in FIG. 6. For the sealing sleeve 5 to be able to be installed, an unobstructed axial expansion of the sealing sleeve 5 must be possible for this radial compression. The sealing sleeve 5 can only be lengthened axially by $\Delta L$, such that in the assembled state, the sealing sleeve can only be lengthened to the clamping length $L_{KR}$ of the rotor 3. Such a sealing sleeve is shown in FIG. 5.

FIG. 5 shows that it makes sense or the design of the sealing sleeve 5 to have ramp-shaped or semicircular ridges 13 that project over the cylindrical body 14 of the sealing sleeve 5, which flatten out during the assembly, resulting in an axial expansion of the sealing sleeve 5. Each of the ridges 13 has a first and second side 18, which may be symmetrical to one another, reflected over the crest of the ridge 13. When a sealing sleeve 5 shown in FIG. 5 is inserted into the hydraulic camshaft adjuster 1 and tensioned with the central screw 4, it can be seen that oil conducting channels are formed between each of the ridges 13, by means of which the pressure chambers 6, 7 can be supplied with hydraulic fluid from the central valve 4. The number of ridges 13 may be different than that is shown in FIGS. 2-5, and is determined by the respective hydraulic design of the hydraulic camshaft adjuster 1.

REFERENCE LIST

1 camshaft adjuster
2 stator
3 rotor
4 central valve
5 sealing sleeve
6 first working chamber
7 second working chamber
8 skin surface
9 first section
10 second section
11 opening
12 bellows
13 ridge
14 basic structure body
15 opening
16 gap
17 central axis
18 sides
$\Delta L$ change in length caused by deformation
$L_0$ length of the sealing sleeve in the initial state
$L_1$ length of the sealing sleeve in the deformed state
$L_{KR}$ clamping length of the rotor
$\Delta X$ change in the radial height caused by the deformation
$X_0$ radial height of the sealing sleeve in the initial state
$X_1$ radial height of the sealing sleeve in the deformed state

The invention claimed is:

1. A hydraulic camshaft adjuster comprising:

a stator;

a rotor that can move in relation to the stator;

a central valve configured to control oil supply to working chambers of the hydraulic camshaft adjuster; and a deformable sealing sleeve between the central valve and the rotor, wherein the sealing sleeve has an initial axial length when it is not subjected to forces, and is deformed after assembly such that the length of the sealing sleeve changes from the initial axial length to an assembled length, wherein the sealing sleeve bears radially, at least in sections, on the central valve and on the rotor, wherein a skin surface of the sealing sleeve forms a bellows;

wherein the sealing sleeve has a plurality of openings on its skin surface for supplying hydraulic fluid to from the central valve to the working chambers, wherein the bellows includes ridges on the skin surface, and wherein at least one of the plurality of openings is located entirely on at least one of the ridges to facilitate flow of the hydraulic fluid from the central valve to the working chambers through the at least one of the ridges.

2. The hydraulic camshaft adjuster according to claim 1, wherein the sealing sleeve has a contour that deviates from a cylindrical shape.

3. The hydraulic camshaft adjuster according to claim 1, wherein the sealing sleeve has a first section with a first diameter, and at least one second section with a second diameter which is greater than the first diameter.

4. The hydraulic camshaft adjuster according to claim 1, wherein the ridges project in semicircles or ramps over a cylindrical body of the sealing sleeve.

5. The hydraulic camshaft adjuster of claim 1, wherein the initial length is less than the assembled length.

6. The hydraulic camshaft adjuster of claim 1, wherein the initial length is greater than the assembled length.

7. The hydraulic camshaft adjuster according to claim 1, wherein the ridges are semi-circular in shape.

8. A method of producing a hydraulic camshaft adjuster having a stator, a rotor moveable relative to the stator, and a central valve configured to control oil supply to working chambers of the hydraulic camshaft adjuster, comprising:

providing a deformable sealing sleeve with a skin surface having a bellows and a plurality of openings on the skin surface for supplying hydraulic fluid to the working chambers, wherein the bellows includes ridges on the skin surface configured to seal against the rotor, and wherein at least one of the plurality of openings is located entirely on one of the ridges, to deliver the hydraulic fluid from an inner side of the sealing sleeve to an outer side of the sealing sleeve via the plurality of openings; and assembling the deformable sealing sleeve radially between the central valve and the rotor, wherein the assembling includes axially compressing the sealing sleeve from a pre-assembled length to an assembled length that is less than the pre-assembled length.

9. The method of claim 8, wherein the axially compressing causes radial expansion of the bellows.

10. The method of claim 8, wherein the step of providing includes forming the sealing sleeve to have the ridges on the skin surface which project in semicircles or ramps over a cylindrical body of the sealing sleeve.

11. A hydraulic camshaft adjuster comprising:

a stator;

a rotor that can move in relation to the stator;

a central valve configured to control oil supply to working chambers of the hydraulic camshaft adjuster; and a deformable sealing sleeve assembled radially between the central valve and the rotor, the sealing sleeve having an axial end contacting the central valve, wherein the central valve supplies a compression force on the axial end of the sealing sleeve causing axial compression of the sealing sleeve such that the sealing sleeve has a first length when the sealing sleeve is not assembled to the central valve and a second length that is less than the first length when assembled;

wherein the sealing sleeve have bellows including ridges formed thereon, wherein the ridges have openings formed therethrough, wherein at least one of the openings is located entirely on one of the ridges, and wherein the ridges are configured to seal against the rotor and also deliver fluid from an inner side of the sealing sleeve to an outer side of the sealing sleeve via the openings.

12. The hydraulic camshaft adjuster of claim 11, wherein the bellows is radially expanded based on the compression force supplied to the axial end of the sealing sleeve.

13. The hydraulic camshaft adjuster of claim 11, wherein the ridges are semi-circular in shape.

* * * * *